US009931668B2

(12) United States Patent
Shook

(10) Patent No.: US 9,931,668 B2
(45) Date of Patent: Apr. 3, 2018

(54) CENTRIFUGAL CASTING CONCRETE PIPE METHOD

(71) Applicant: Action Products Marketing Corp., Johnston, IA (US)

(72) Inventor: William Shook, Johnston, IA (US)

(73) Assignee: Action Products Marketing Corp., Johnston, IA (US)

( * ) Notice: Subject to any disclaimer, the term of this patent is extended or adjusted under 35 U.S.C. 154(b) by 88 days.

(21) Appl. No.: 14/788,889

(22) Filed: Jul. 1, 2015

(65) Prior Publication Data

US 2016/0017590 A1 Jan. 21, 2016

Related U.S. Application Data

(60) Provisional application No. 62/020,517, filed on Jul. 3, 2014.

(51) Int. Cl.

| | |
|---|---|
| ***B05D 7/22*** | (2006.01) |
| *E03F 3/06* | (2006.01) |
| *B05D 1/02* | (2006.01) |

(52) U.S. Cl.

CPC ..... *B05D 7/222* (2013.01); *B05D 1/02* (2013.01); *E03F 2003/065* (2013.01)

(58) Field of Classification Search

CPC .. B05D 7/222; B05D 7/22; B05D 1/02; E03F 2003/065

USPC ..... 427/236, 230, 427.3

See application file for complete search history.

(56) References Cited

U.S. PATENT DOCUMENTS 3,880,176 A * 4/1975 Horne ..... E03F 9/00 118/306

5,452,853 A 9/1995 Shook

OTHER PUBLICATIONS

CentriPipe—Centrifugally Cast Concrete Pipe,Jun. 27, 2014, http://www.permaform.net/site/Products/CentriPipe/tabid/81/Default.aspx.

Culvert repair: slip-lining versus relining with centrifugally cast CentriPipe, Jun. 7, 2013, http://drivingstrategicsales.com/infrastructure/culvert-repair-photos-comparing-sliplining-centrifugally-cast-centripipe/.

Stormwater The Journal for Surface Water Quality Professionals, Jun. 2013, www.stormh2o.com.

Storm Water Solutions—Nothing Else Came Close, Nov. 26, 2012, http://www.estormwater.com/nothing-else-came-close?utm_campaign=SW%2011%2F2012%20SWS%20-%20Case%20of%20the%20Month&utm_medium=newsletter&utm_source=Storm%20Water%20Solutions%20Case-of-the-Month&utm_content=437219.

Centri Pipe—Introducing Centri-Pipe!, Jun. 27, 2014, http://www.centripipe.com/site/CentriPipe/HowitWorks/tabid/74/Default.aspx.

Centri Pipe—Corroded Storm Pipe, Is there any Other Kind?, Centri-Pipe: Another Trenchless Solution from AP/M Permaform, Jun. 27, 2014, http://www.centripipe.com/site/.

CentriPipe—Centrifugally Cast Concrete Pipe, Jun. 27, 2014, http://www.permaform.net/site/Products/CentriPipe/tabid/81/Default.aspx.

* cited by examiner

*Primary Examiner* — Kirsten Jolley

(74) *Attorney, Agent, or Firm* — Nyemaster Goode, PC

(57) ABSTRACT

A method of lining an interior wall of a pipe is provided. Casting equipment such as a spin caster is used to centrifugally cast material onto the interior wall while the pipe is partially filled with liquid so as to form a coating on the wall above the liquid. In some embodiments the method further comprises diverting liquid from the pipe after the casting (Continued)

step, and then lining the wall of the pipe below the coating with material to form a continuous lining on the wall.

31 Claims, 2 Drawing Sheets

CENTRIFUGAL CASTING CONCRETE PIPE METHOD

BACKGROUND

This application is based upon U.S. Provisional Application Ser. No. 62/020,517 filed Jul. 3, 2014, the complete disclosure of which is hereby expressly incorporated by this reference.

Over time, culverts and sanitary sewer pipes deteriorate due to numerous factors. For example, corrugated metal pipes commonly used for culverts rust and buckle, and typically have a design life of 40-50 years. There are several options for replacement or repair of deteriorated pipes. One option is, pipe replacement, which requires digging, and in the case of under the road culverts, the road must be closed for excavation and laying of the new pipe. Another option is slip lining of the existing pipe, which often reduces the capacity by one-third or more. A third option is cured-in-place liners, which can be very costly in large diameters or non-round shapes.

A fourth option for repairing deteriorated culverts and sewer pipes is centrifugally cast concrete pipe (CCCP), which is economical and durable. U.S. Pat. No. 5,452,853 issued on Sep. 26, 1995 which is hereby expressly incorporated by this reference generally discloses the CCCP process. The centrifugally cast concrete pipe rehabilitation method applies thin layers of a coating such as structural grout, epoxy mortar, or polymer coating to produce a smooth, tightly bonded, water proofed finished product which does not significantly reduce the inner diameter of the pipe or culvert. Thus, after the repair the flow through the pipe or culvert is substantially the same as (or sometimes even better than) with the original pipe. This CCCP method is typically used on pipes having diameters between 30 inches to 120 inches, or larger.

The CCCP process begins with inspection of the pipe to be remediated to determine the thickness of the concrete to be applied inside the pipe, based on the depth, size, and shape of the pipe, depth of the local water table, water hydraulic pressure, and other factors. Then, flow through the pipe is stopped or diverted so that gravel, mud, roots and other debris can be removed from the pipe. The pipe interior is then scoured using a high pressure washer, and leaks and inverts are repaired, prior to concrete spin casting. The high speed concrete spin caster is then positioned in the pipe at the far end. The casting head moves through the pipe at a calculated speed to centrifugally cast a material evenly around the interior of the pipe to form a liner or coating. As used generally in the art, a "liner" is thicker than a "coating" and a "liner" is usually structural wherein a "coating" is protective but not structural. As used herein, however, the term "coating" includes both structural liners as well as non-structural protective coatings. The material used to form the coating may be a cementitious material, polymer, anti-bacterial agent, curing compound, or other suitable material or combination of materials. Regardless of the material used to form the coating, the resulting coating may be a thick structural layer or a thin protective layer. The spin caster can be stopped and started as needed, without joints or gaps. Depending on the desired thickness of the coating, multiple passes of the casting head may be required through the pipe to provide the desired strength. This coating can be applied to pipes made from any suitable material, including concrete, steel, plastic, corrugated metal pipe, and brick/mortar culverts. The coating cures or dries in place within a few hours, so that the culvert or sewer pipe can be quickly returned to service. The new coating water proofs, seals, and/or structurally reinforces the old pipe, and provides corrosion protection for sanitary and storm culverts or pipes, without trenching or digging, and at significant savings.

One downside to the CCCP process is the time that flow through the original pipe must be stopped or diverted during the application process. Since the casting equipment is moved through the pipe relatively slowly in the CCCP process, flow diversion is costly, particularly if multiple passes of the casting equipment through the pipe is required to achieve a desired thickness and/or strength of the coating.

Therefore, one objective of the present invention is the provision of an improved or modified centrifugally cast pipe liner process which minimizes flow diversion or stoppage time.

Another objective of the present invention is the provision of a CCCP process wherein the centrifugal casting is accomplished without diverting flow through the culvert or pipe.

A further objective of the present invention is the provision of a culvert and sewer pipe rehabilitation process which diverts water flow for a shorter time period than conventional CCCP processes.

SUMMARY

According to one aspect of the invention, a method of coating or lining an interior wall of a pipe is provided. Casting equipment such as a spin caster is used to centrifugally cast a material onto the interior wall while the pipe is partially filled with liquid so as to form a coating on the wall above the liquid. In some embodiments the method further comprises diverting fluid from the pipe after the casting step, and then lining the wall of the pipe below the coating with material to form a continuous lining on the wall.

According to another aspect of the invention, a method for applying an uncured material to an interior surface of an enclosed pipe wall is provided. First, casting equipment such as a spin caster is placed within the enclosed pipe while the pipe is partially filled with liquid to create a wall portion above the liquid and a wall portion below the liquid. The spin caster has a rotatable spreader in fluid communication with a source of material. Next, the uncured material is introduced to the interior surface of the enclosed pipe wall through the rotatable spreader by rotating said rotatable spreader with sufficient velocity to cast material onto the interior surface so as to form a coating on the wall portion above the liquid. The coating is allowed to cure forming a cured coating on the wall portion above the liquid. In some embodiments the method further comprises diverting fluid from the pipe after the coating is formed, and then lining the interior surface of the enclosed pipe below the coating with material to form a continuous lining on the wall.

DETAILED DESCRIPTION

Figure 1:
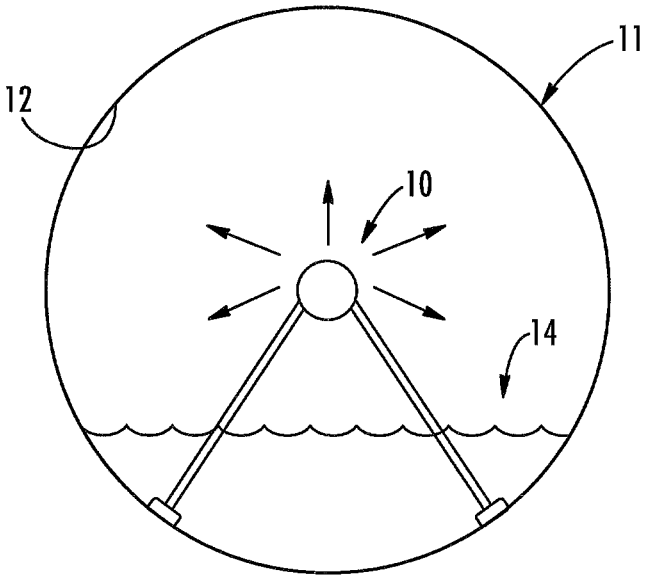
FIG. 1 is an end view of a culvert or sewer pipe with a centrifugal casting head positioned therein for performing the centrifugal casting method according to an embodiment of the present invention.
Figure 3:
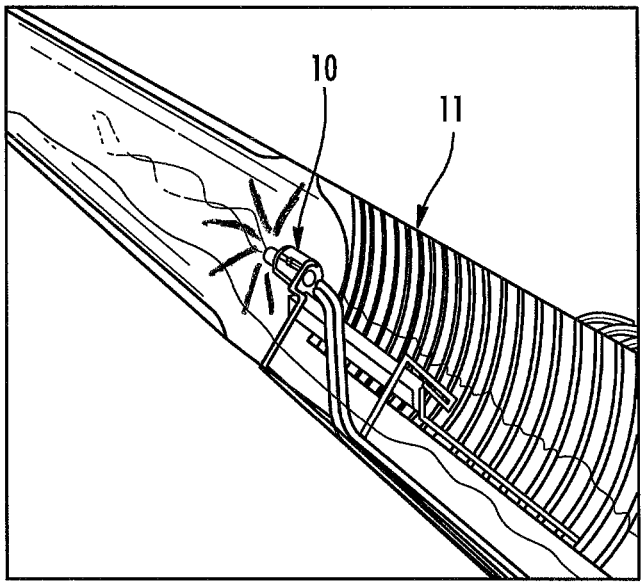
FIG. 3 is a perspective view of a culvert or sewer pipe with a centrifugal casting head positioned performing the centrifugal casting method according to an embodiment of the present invention.

The culvert and sewer pipe rehabilitation process according to the present invention is a modification from the standard centrifugal cast concrete pipe rehabilitation process. In the modified process of the present invention, water (or other fluid) in the pipe 11 is not diverted or stopped, as in the first step of the conventional CCCP process. The water fills a portion of the pipe 11 volume to create a water line 14. There is a portion of the inner pipe wall 12 which is above the water line 14 to receive a material 16 as described below. The material 16 may be a cementitious material, polymer, curing agent, antibacterial agent, or other suitable material or combination of materials. Regardless of the material used to form the coating, the resulting coating may be a thick structural layer or a thin protective layer. The water may fill any suitable portion of the volume of the pipe 11 including about one-sixteenth, about one-eighth, about one-sixth, about one-quarter, about one-third, or about one-half. The pipe wall 12 above the water line 14 is cleaned in any convenient manner, such as a pressure spin washer. Casting equipment such as a spin caster 10 is used to apply the material. The spin caster 10 has a rotatable spreader in fluid communication with a source of material. The rotatable spreader is positioned above the water line 14 and mounted on wheels or skids which allow it to move through the pipe 11. The spin caster 10 moves through the old pipe 11 without diverting fluid flow through the pipe, as shown in FIGS. 1 and 3. The spin caster 10 may be pushed, pulled, or driven under its own power as it moves through the pipe 11. The material is applied by the rotating casting head to the inner pipe wall 12 to form a coating 16 (e.g., a concrete or polymer layer) above the water line 14. The casting head may be centered within pipe 11 (FIG. 1) or it may be positioned off-center relative to the longitudinal axis of the pipe. Multiple passes of the spin caster 10 can be made, without diverting or stopping water flow in the pipe 11. Since the spin caster 10 operates in a full 360° spray pattern, the material entering the water in the pipe 11 does not coat the pipe wall 12 below the water line 14. The material sprayed into the water is diluted and is washed through the pipe to a downstream end wherein the water with suspended materials is removed or recycled by vacuuming the diluted material from the pipe 11 or by any other suitable means. Thus, the newly formed coating 16 on the old pipe wall does not cover the full 360° circumference of the inner pipe wall 12 because it does not coat the portion of the pipe wall 12 that is below the water line 14.

Figure 2:
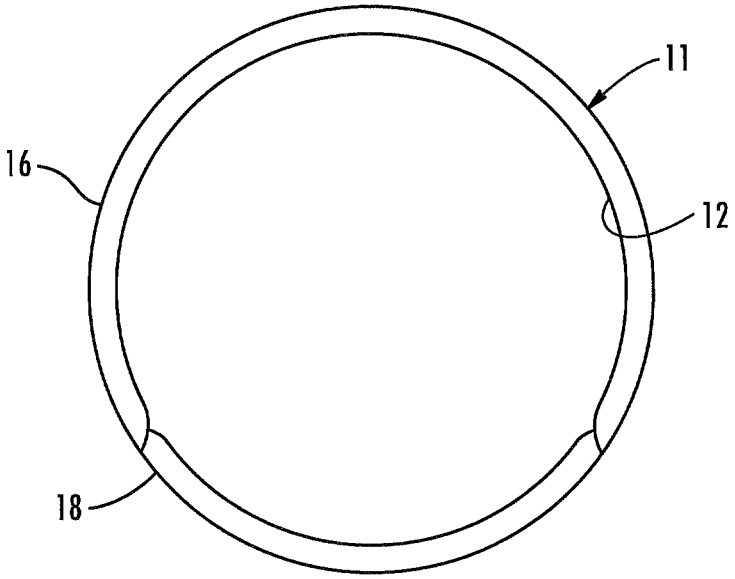
FIG. 2 is an end view of the pipe upon completion of the rehabilitation process according to an embodiment of the present invention.

Then, if it is decided to line the lower portion of the pipe wall 12 below the water line 14, the water flow is diverted or stopped, and the lower portion of pipe wall 12 is cleaned. Then, the lower, unlined portion of the pipe can be sprayed with material, without using the 360° casting equipment, to form a lower coating 18 layer. For example, an operator can walk through the pipe and manually spray the lower portion of the pipe with a hose which was below the water line 14 when the casting equipment 10 was moved through the pipe. The material used to create the lower coating 18 may by the same as or different from the material used to create the upper coating 16. Together, the upper coating 16 and the lower coating 18 form a continuous lining on the inner pipe wall 12 as shown in FIG. 2. This coating of the lower wall of the pipe can be accomplished more quickly than the conventional 360° CCCP method, such that the time and cost for flow diversion from the pipe is minimized. Since the casting equipment is moved through the pipe relatively slowly in the CCCP process, flow diversion is costly, particularly if multiple passes of the casting equipment through the pipe is required to achieve a desired thickness and strength of the liner.

As explained above, the material applied to the pipe wall 12 may be a non-structural surface coating such as a curing agent or an antibacterial agent. These types of surface coatings may be mixed with structural materials (such as cementitious materials or polymers) before application through the spin caster so that the resultant material applied to the pipe wall 12 is a mixture of structural and non-structural materials. In other embodiments non-structural surface coatings are applied after the upper coating 16 is formed. For example, a curing compound can be applied to the uncured material 16 after it has been sprayed onto the pipe wall 12 to prevent shrinkage cracking. Another example, before or after the lower layer 18 is added, an antibacterial agent can be applied to the upper layer 16, above the water line 14, to effectively prevent MIC and eliminate *Thiobacallius* bacteria on contact, and thereby prevent or minimize corrosion of the upper coating 16 layer. *Thiobacallius* bacteria metabolizes to convert oxygen and hydrogen gas into sulfuric acid, which quickly erodes or dissolves concrete and other materials. Therefore, application of an antibacterial agent will prevent or minimize such deterioration. One commercial antibacterial product is CON(MIC)SHIELD sold by Action Products Marketing Corp. CON(MIC)SHIELD is an EPA registered antibacterial agent that molecularly bonds to concrete, and will not wash off, peel off, delaminate, or pinhole. Some types of non-structural surface coatings such as CON(MIC)SHIELD can only be used in sanitary sewers due to environmental regulations.

While the Figures show the inventive process used on a round pipe and culverts, it is understood that this process can also be used on non-round pipes and culverts such as elliptical pipes, arched pipes, square pipes, tapered pipes, and other structures where conventional CCCP is used.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A method of lining an interior wall of a pipe comprising:

centrifugally casting material onto the interior wall while the pipe is partially filled with liquid so as to form a coating which forms a lining on the interior wall above the liquid; wherein the material is cementitious.

2. The method of claim 1 further comprising diverting liquid from the pipe after the casting step, and then lining the interior wall of the pipe below the coating with material to form a continuous lining on the interior wall.

3. The method of claim 2 further comprising cleaning the wall below the coating after the liquid is diverted and before the lining step.

4. The method of claim 3 further comprising recycling the diverted liquid.

5. The method of claim 1 wherein at least some material enters the liquid during the casting step but is diluted and does not cure.

6. The method of claim 5 further comprising removing the uncured material from the liquid.

7. The method of claim 1 wherein the pipe has a volume and the liquid fills between about one-sixteenth and one-half of the pipe volume during the casting step.

8. The method of claim 1 further comprising moving the spin caster through the pipe during the casting step.

9. The method of claim 1 wherein the material is structural.

10. A method for applying an uncured material to an interior surface of a pipe having an enclosed pipe wall, said method comprising:

placing a spin caster within said pipe while the pipe is partially filled with liquid, said pipe having a wall portion above the liquid and a wall portion below the liquid, said spin caster having a rotatable spreader in fluid communication with a source of uncured material;

rotating said rotatable spreader with sufficient velocity to cast the uncured material onto the enclosed pipe wall so as to form a coating on the wall portion above the liquid; and allowing the coating to cure forming a cured coating on the wall portion above the liquid.

11. The method of claim 10 further comprising diverting liquid from the pipe after the coating is formed, and then lining the interior surface of the enclosed pipe below the coating with a material to form a continuous lining on the interior surface of the pipe.

12. The method of claim 11 further comprising cleaning the wall below the coating after the liquid is diverted and before the lining step.

13. The method of claim 10 wherein the pipe has a volume and the liquid fills between about one-sixteenth and one-half of the pipe volume during the rotating step.

14. The method of claim 10 further comprising moving the spin caster through the pipe during the rotating step.

15. The method of claim 10 wherein the rotatable spreader is rotated 360 degrees but the uncured coating does not adhere to the wall portion below the liquid.

16. The method of claim 11 wherein the lining step includes applying the material to the interior surface of the enclosed pipe below the coating without using a spin caster.

17. The method of claim 10 wherein the uncured material is cementitious.

18. The method of claim 10 wherein the uncured material is structural.

19. The method of claim 10 wherein the unmaterial is polymer.

20. The method of claim 10 wherein the unmaterial is non-structural.

21. The method of claim 11 wherein the uncured material cast from the rotatable spreader and the material used to line the enclosed pipe below the coating are the same.

22. A method for applying an uncured material to an interior surface of a pipe having an enclosed pipe wall, said method comprising:

placing a spin caster within said pipe while the pipe is partially filled with liquid, said pipe having a wall portion above the liquid and a wall portion below the liquid;

centrifugally casting material onto the enclosed pipe wall using the spin caster to form a coating on the wall portion above the liquid;

allowing the coating to cure forming a cured coating on the wall portion above the liquid; and diverting the liquid from the pipe after the coating is formed, and then lining the enclosed pipe wall below the coating with material to form a concrete lining on the enclosed pipe wall.

23. The method of claim 22 wherein the pipe has a volume and the liquid fills between about one-sixteenth and one-half of the pipe volume during the casting step.

24. The method of claim 22 further comprising moving the spin caster through the pipe during the casting step.

25. The method of claim 22 wherein the rotatable spreader is rotated 360 degrees but the uncured coating does not adhere to the wall portion below the liquid.

26. The method of claim 22 wherein the lining step includes applying material to the interior surface of the enclosed pipe below the coating without using a spin caster.

27. The method of claim 26 wherein the pipe has a center and the spin caster is not positioned in the center of the pipe.

28. The method of claim 22 wherein the material is cementitious.

29. The method of claim 22 wherein the material is structural.

30. The method of claim 22 wherein the material is polymer.

31. The method of claim 22 wherein the material is non-structural.

* * * * *